US010035634B2

(12) United States Patent
Murphy

(10) Patent No.: US 10,035,634 B2
(45) Date of Patent: Jul. 31, 2018

(54) FOLDABLE COUPON HOLDING PACKET

(71) Applicant: The Segerdahl Corp., Wheeling, IL (US)

(72) Inventor: Brock James Murphy, Elgin, IL (US)

(73) Assignee: THE SEGERDAHL CORP., Wheeling, IL (US)

( * ) Notice: Subject to any disclaimer, the term of this patent is extended or adjusted under 35 U.S.C. 154(b) by 0 days.

(21) Appl. No.: 15/286,827

(22) Filed: Oct. 6, 2016

(65) Prior Publication Data

US 2018/0099799 A1 Apr. 12, 2018

(51) Int. Cl.
*B65D 73/00* (2006.01)
*B65D 79/00* (2006.01)

(52) U.S. Cl.
CPC ..... *B65D 73/0078* (2013.01); *B65D 79/00* (2013.01)

(58) Field of Classification Search
CPC ..... B65D 73/00; B65D 73/0042; B65D 73/0078; B65D 79/00; G09F 1/00; G09F 1/06; G09F 1/08
USPC ... 40/124.06, 124.07, 124.08, 124.1, 124.11, 40/124.14; 206/232, 472–476, 757, 759, 206/762, 763, 766, 768; 229/70–81
See application file for complete search history.

(56) References Cited

U.S. PATENT DOCUMENTS

| | | | | |
|---|---|---|---|---|
| 1,379,739 | A | 5/1921 | Bennett | |
| 4,349,973 | A | 9/1982 | Penick et al. | |
| 5,595,008 | A | 1/1997 | Johnson | |
| 5,933,989 | A | 8/1999 | Volkert et al. | |
| 6,199,308 | B1 | 3/2001 | Westendorp | |
| 7,111,736 | B2 * | 9/2006 | Petter | G09F 1/08 40/124.06 |
| 8,499,478 | B1 | 8/2013 | Glass et al. | |
| 9,542,865 | B2 * | 1/2017 | Simmons | G09F 1/06 |

* cited by examiner

*Primary Examiner* — Bryon Gehman
(74) *Attorney, Agent, or Firm* — Klintworth & Rozenblat IP LLP

(57) ABSTRACT

A packet according to some embodiments of the disclosure is provided for holding a goods package. The packet includes a carrier on which a pop-up bag is mounted. When the packet is folded, the carrier and the pop-up bag are substantially flattened. When the packet is opened, the carrier is unfolded which opens the pop-up bag. Coupons or other loose articles can be place in the pop-up bag.

22 Claims, 7 Drawing Sheets

FOLDABLE COUPON HOLDING PACKET

FIELD OF THE DISCLOSURE

The present disclosure relates to packets for holding goods, such as coupons, gift cards or other loose materials.

BACKGROUND

Packets or cards are known in the prior art for holding goods, such as coupons or gift cards. The packet or card may be made out one or more of sheets whose surfaces has a permanent pocket, formed by sewing, sealing, gluing, etc., capable of holding the goods. The packet can be opened and the goods removed from the pocket.

SUMMARY

A packet according to some embodiments of the disclosure is provided for holding goods, such as coupons, gift cards or other loose materials. The packet includes a carrier on which a pop-up bag is mounted. When the packet is folded, the carrier and the pop-up bag are substantially flattened. When the packet is opened, the carrier is unfolded which opens the pop-up bag. Coupons or other loose articles can be place in the pop-up bag.

This Summary is provided merely for purposes of summarizing some example embodiments so as to provide a basic understanding of some aspects of the disclosure. Accordingly, it will be appreciated that the above described example embodiments are merely examples and should not be construed to narrow the scope or spirit of the disclosure in any way. Other embodiments, aspects, and advantages of various disclosed embodiments will become apparent from the following detailed description taken in conjunction with the accompanying drawings which illustrate, by way of example, the principles of the described embodiments.

BRIEF DESCRIPTION OF THE DRAWINGS

The organization and manner of the structure and operation of the disclosed embodiments, together with further objects and advantages thereof, may best be understood by reference to the following description, taken in connection with the accompanying drawings, which are not necessarily drawn to scale, wherein like reference numerals identify like elements in which.

DETAILED DESCRIPTION

Figure 1:
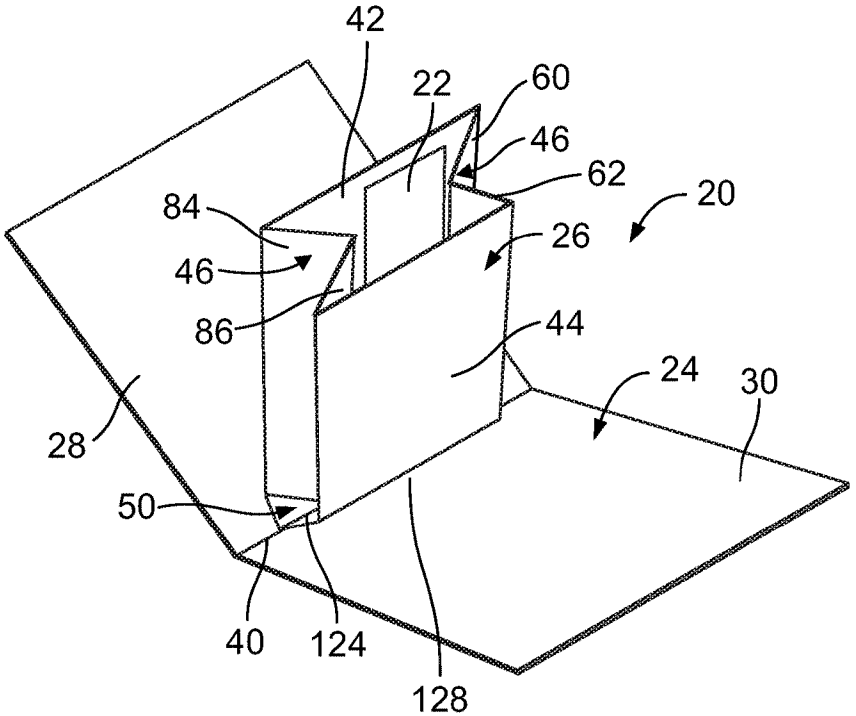
FIG. 1 is a perspective view of a packet holding a goods package in an open condition.

While the disclosure may be susceptible to embodiment in different forms, there is shown in the drawings, and herein will be described in detail, a specific embodiment with the understanding that the present disclosure is to be considered an exemplification of the principles of the disclosure, and is not intended to limit the disclosure to that as illustrated and described herein. Therefore, unless otherwise noted, features disclosed herein may be combined together to form additional combinations that were not otherwise shown for purposes of brevity. It will be further appreciated that in some embodiments, one or more elements illustrated by way of example in a drawing(s) may be eliminated and/or substituted with alternative elements within the scope of the disclosure.

Figure 2:
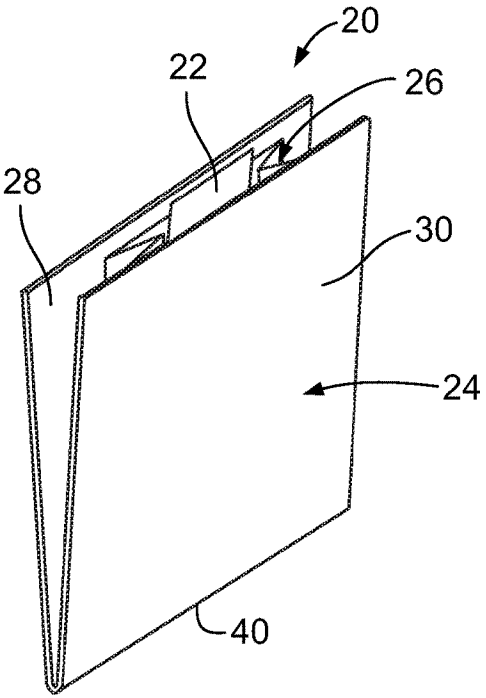
FIG. 2 is a perspective view of the packet holding the goods package in closed condition.

A packet 20 for holding goods 22 is provided. The packet 20 includes a carrier 24 to which a pop-up bag 26 is attached. The packet 20 is comprised of paper or cardboard stock. The goods 22 may be any number of items, such as coupons, gift cards, advertising materials, small toys, etc. The packet 20 can be placed into an unfolded condition, as shown in FIG. 1, wherein the carrier 24 and the pop-up bag 26 are open, and are upright and expanded, or can be placed into a folded condition, as shown in FIG. 2, wherein the carrier 24 and the pop-up bag 26 are generally flattened. In the unfolded condition, goods 22 can be easily placed into, or removed from, the pop-up bag 26.

Figure 3:
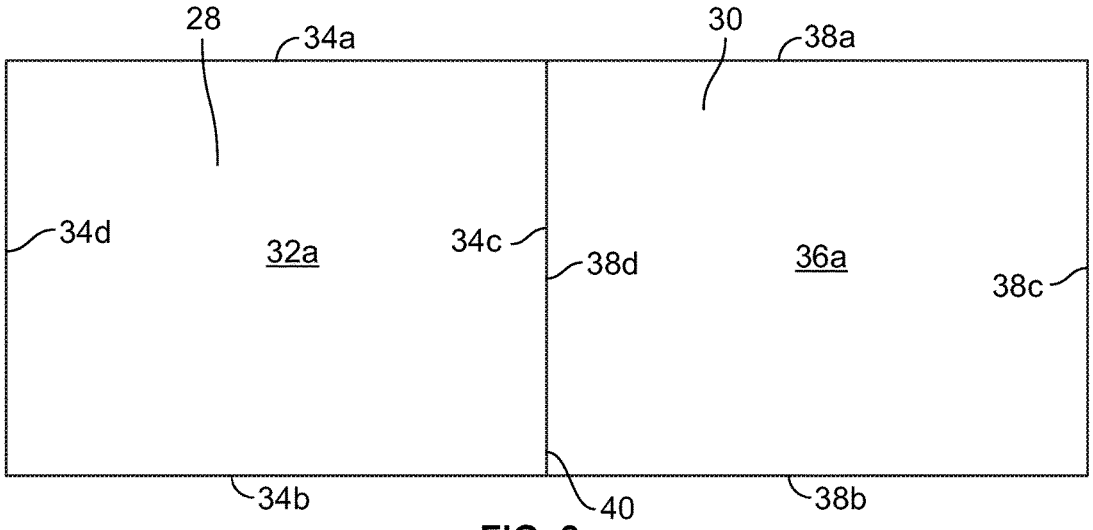
FIG. 3 is a top plan view of a carrier which forms part of the packet in an open condition.
Figure 4:
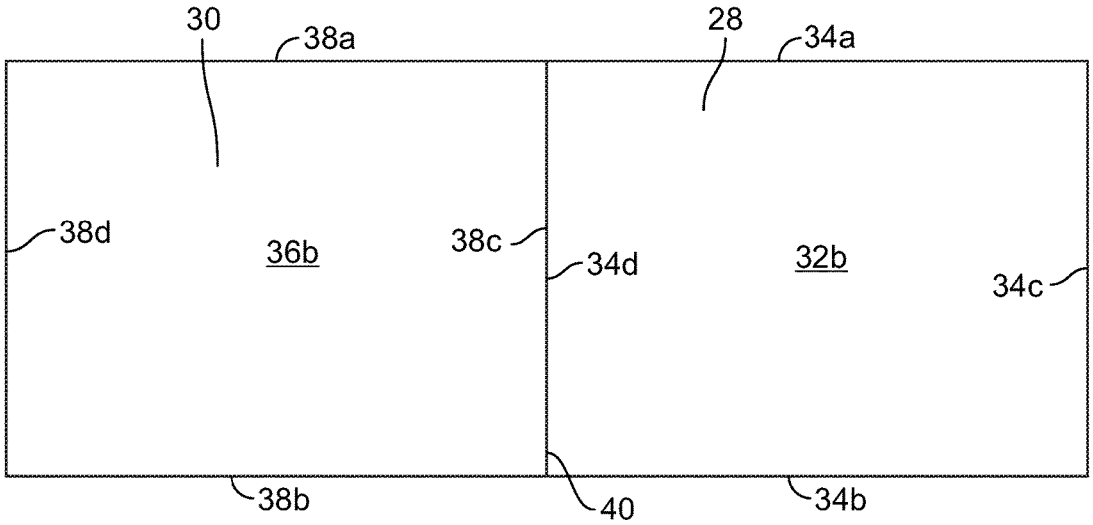
FIG. 4 is a bottom plan view of the carrier of FIG. 3 in the open condition.

As shown in FIGS. 3 and 4, the carrier 24 is formed of first and second planar panels 28, 30 which are foldably attached to each other. In an embodiment, the carrier 24 is formed of a single sheet of paper or cardboard stock.

The first panel 28 of the carrier 24 has first and second surfaces 32*a*, 32*b* which are defined by first and second edges 34*a*, 34*b*, a third edge 34*c* extending between the first and second edges 34*a*, 34*b* at the ends of the first and second edges 34*a*, 34*b*, and a fourth edge 34*d* extending between the first and second edges 34*a*, 34*b* at the opposite ends of the first and second edges 34*a*, 34*b*. The first and second edges 34*a*, 34*b* define a width of the first panel 28 therebetween; the third and fourth edges 34*c*, 34*d* define a length of the first panel 28 therebetween. In an embodiment, the first and second edges 34*a*, 34*b* are parallel to each other and the third and fourth edges 34*c*, 34*d* are parallel to each other and perpendicular to the first and second edges 34*a*, 34*b*.

The second panel 30 of the carrier 24 has first and second surfaces 36*a*, 36*b* which are defined by first and second edges 38*a*, 38*b*, a third edge 38*c* extending between the first and second edges 38*a*, 38*b* at the ends of the first and second edges 38*a*, 38*b*, and a fourth edge 38*d* extending between the first and second edges 38*a*, 38*b* at the opposite ends of the first and second edges 38*a*, 38*b*. The first and second edges 38*a*, 38*b* define a width of the second panel 30 therebetween; the third and fourth edges 38*c*, 38*d* define a length of the second panel 30 therebetween. In an embodiment, the first and second edges 38*a*, 38*b* are parallel to each other and the third and fourth edges 38*c*, 38*d* are parallel to each other and perpendicular to the first and second edges 38*a*, 38*b*.

The first and second panels 28, 30 are attached to each other along a fold line 40 which is provided at the third edge 34*c* of the first panel 28 and at the fourth edge 38*d* of the second panel 30, such that when the panels 28, 30 are folded onto each other into the folded condition, the first surfaces 32*a*, 36*a* face each other. In an embodiment, when the carrier 24 is the unfolded condition, the first edges 34*a*, 38*a* are aligned with each other and in some embodiments, the first edges 34*a*, 38*a* form a straight line; when the carrier 24 is in the unfolded condition, the second edges 34*b*, 38*b* are aligned with each other and in some embodiments, the second edges 34*b*, 38*b* form a straight line. In an embodiment, the second and fourth edges 34*b*, 34*d*, 38*b*, 38*d* are parallel to each other and in some embodiments, the second and fourth edges 34*b*, 34*d*, 38*b*, 38*d* form straight lines.

The pop-up bag 26 is attached to the carrier 24 such that when the carrier 24 is unfolded into the unfolded condition, the pop-up bag 26 opens, and such that when the carrier 24 is folded into the folded condition, the pop-up bag 26 closes and folds to be generally flat. In an embodiment, the pop-up bag 26 is formed of a single sheet of paper or cardboard stock.

Figure 5:
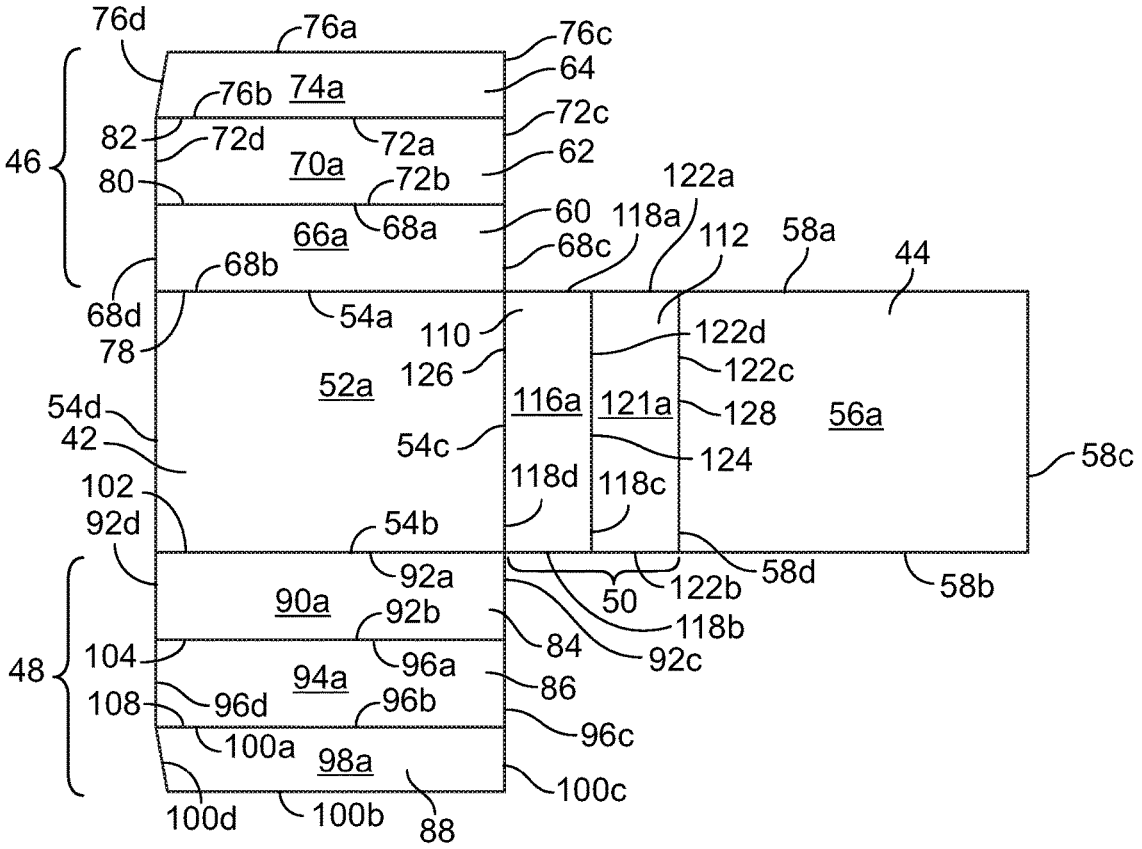
FIG. 5 is a top plan view of a blank used to form a pop-up bag which forms part of the packet, the blank having the fold lines which are formed during formation of the pop-up bag shown thereon.
Figure 6:
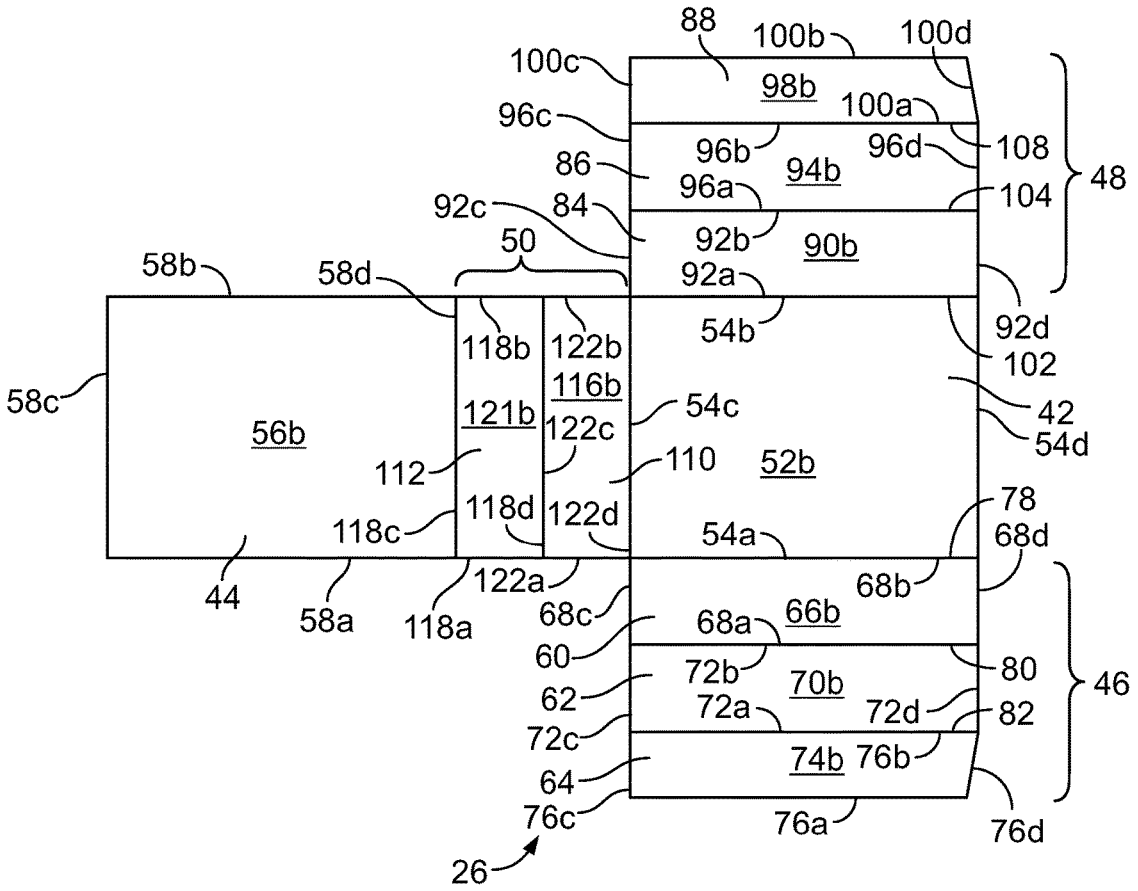
FIG. 6 is a bottom plan view of the blank of FIG. 5.

The pop-up bag 26 is formed of a first side panel 42, a second side panel 44, a third side panel 46 and a fourth side panel 48 which are connected together as described herein, and a bottom panel 50 provided at the bottom edges of each of the side panels 42, 44, 46, 48. As shown in FIGS. 5 and 6 in an unassembled and flattened condition, the panels 42, 44, 46 48, 50 generally form a T-shape. In an assembled condition as shown in FIG. 1, the bottom panel 50 is directly attached to the first and second side panels 42, 44, and the bottom panel 50 is attached to the carrier 24. In an embodiment, the bottom panel 50 is formed integrally with the side panels 42, 44 from a single sheet of material. In an embodiment, the bottom panel 50 is formed as a separate sheet and attached to the side panels 42, 44, but still including the fold lines 126, 128.

The first side panel 42 is planar has first and second surfaces 52*a*, 52*b* which are defined by first and second edges 54*a*, 54*b*, a third edge 54*c* extending between the first and second edges 54*a*, 54*b* at the ends of the first and second edges 54*a*, 54*b*, and a fourth edge 54*d* extending between the first and second edges 54*a*, 54*b* at the opposite ends of the first and second edges 54*a*, 54*b*. The first and second edges 54*a*, 54*b* define a width of the first side panel 42 therebetween; the third and fourth edges 54*c*, 54*d* define a length of the first side panel 42 therebetween. In an embodiment, the first and second edges 54*a*, 54*b* are parallel to each other and the third and fourth edges 54*c*, 54*d* are parallel to each other and perpendicular to the first and second edges 54*a*, 54*b*.

The second side panel 44 is planar has first and second surfaces 56*a*, 56*b* which are defined by first and second edges 58*a*, 58*b*, a third edge 58*c* extending between the first and second edges 58*a*, 58*b* at the ends of the first and second edges 58*a*, 58*b*, and a fourth edge 58*d* extending between the first and second edges 58*a*, 58*b* at the opposite ends of the first and second edges 58*a*, 58*b*. The first and second edges 58*a*, 58*b* define a width of the second side panel 44 therebetween; the third and fourth edges 58*b*, 58*d* define a length of the second side panel 44 therebetween. In an embodiment, the first and second edges 58*a*, 58*b* are parallel to each other and the third and fourth edges 58*c*, 58*d* are parallel to each other and perpendicular to the first and second edges 58*a*, 58*b*.

In an embodiment, the first and second side panels 42, 44 have the same dimensions. The first and second side panels 42, 44 could have different lengths.

The third side panel 46 connects the first edges 54*a*, 58*a* of the first and second side panels 42, 44 together. The third side panel 46 is formed of a plurality of folded panel segments 60, 62 which form a corrugated surface, and a flap panel segment 64 which attaches the folded panel segments 60, 62 to the second side panel 44. In an embodiment, the panel segments 60, 62 are folded relative to each other to form a V-shape. In other embodiments, multiple panel segments can be provided to form a W-shape or multiple V-shapes or W-shapes which are joined together. As shown, the panel segments 60, 62 forms a V-shape in the completed packet 20.

The first panel segment 60 is planar and has first and second surfaces 66*a*, 66*b* which are defined by first and second edges 68*a*, 68*b*, a third edge 68*c* extending between the first and second edges 68*a*, 68*b* at the ends of the first and second edges 68*a*, 68*b*, and a fourth edge 68*d* extending between the first and second edges 68*a*, 68*b* at the opposite ends of the first and second edges 68*a*, 68*b*. The first and second edges 68*a*, 68*b* define a width of the first panel segment 60 therebetween; the third and fourth edges 68*c*, 68*d* define a length of the first panel segment 60 therebetween. In an embodiment, the first and second edges 68*a*, 68*b* are parallel to each other and the third and fourth edges 68*c*, 68*d* are parallel to each other and perpendicular to the first and second edges 68*a*, 68*b*.

The second panel segment 62 is planar and has first and second surfaces 70*a*, 70*b* which are defined by first and second edges 72*a*, 72*b*, a third edge 72*c* extending between the first and second edges 72*a*, 72*b* at the ends of the first and second edges 72*a*, 72*b*, and a fourth edge 72*d* extending between the first and second edges 72*a*, 72*b* at the opposite ends of the first and second edges 72*a*, 72*b*. The first and second edges 72*a*, 72*b* define a width of the second panel segment 62 therebetween; the third and fourth edges 72*c*, 72*d* define a length of the second panel segment 62 therebetween. In an embodiment, the first and second edges 72*a*, 72*b* are parallel to each other and the third and fourth edges 72*c*, 72*d* are parallel to each other and perpendicular to the first and second edges 72*a*, 72*b*.

The third panel segment 64 is planar has first and second surfaces 74*a*, 74*b* which are defined by first and second edges 76*a*, 76*b*, a third edge 76*c* extending between the first and second edges 76*a*, 76*b* at the ends of the first and second edges 76*a*, 76*b*, and a fourth edge 76*d* extending between the first and second edges 76*a*, 76*b* at the opposite ends of the first and second edges 76*a*, 76*b*. The first and second edges 76*a*, 76*b* define a width of the third panel segment 64 therebetween; the third and fourth edges 76*c*, 76*d* define a length of the third panel segment 64 therebetween. In an embodiment, the first and second edges 76*a*, 76*b* are parallel to each other and the third and fourth edges 76*c*, 76*d* are parallel to each other and perpendicular to the first and second edges 76*a*, 76*b*.

The second edge 68*b* of the first panel segment 60 is connected to the first edge 54*a* of the first side panel 42 at a fold line 78. The first edge 68*a* of the first panel segment 60 is connected to the second edge 72*b* of the second panel segment 62 at a fold line 80. The first edge 72*a* of the second panel segment 62 is connected to the second edge 76*b* of the third panel segment 62 at a fold line 82. In the unassembled and flattened condition as shown in FIGS. 5 and 6, the third edges 68*c*, 72*c*, 76*c* are aligned with each other and in some embodiments form a straight line, and the fourth edges 68*d*, 72*d*, 76*d* are aligned with each other and in some embodiments form a straight line or a generally straight line. In some embodiments, the fourth edge 76*d* is angled relative to the fourth edges 68*d*, 72*d*. In the assembled condition as shown in FIG. 1, the segments 60, 62 are folded relative to each other to form a V-shape.

The fourth side panel 48 connects the second edges 54*b*, 58*b* of the first and second side panels 42, 44 together. The fourth side panel 48 is formed of a plurality of folded panel segments 84, 86 which form a corrugated surface, and a flap panel segment 88 which attaches the folded panel segments 84, 86 to the second side panel 44. In an embodiment, the panel segments 84, 86 are folded relative to each other to form a V-shape. In other embodiments, multiple panel segments can be provided to form a W-shape or multiple V-shapes or W-shapes which are joined together. As shown, the panel segments 84, 86 forms a V-shape in the completed packet 20.

The first panel segment 84 is planar and has first and second surfaces 90*a*, 90*b* which are defined by first and second edges 92*a*, 92*b*, a third edge 92*c* extending between the first and second edges 92*a*, 92*b* at the ends of the first and second edges 92*a*, 92*b*, and a fourth edge 92*d* extending between the first and second edges 92*a*, 92*b* at the opposite ends of the first and second edges 92*a*, 92*b*. The first and second edges 92*a*, 92*b* define a width of the first panel segment 84 therebetween; the third and fourth edges 92*c*, 92*d* define a length of the first panel segment 84 therebetween. In an embodiment, the first and second edges 92*a*, 92*b* are parallel to each other and the third and fourth edges 92*c*, 92*d* are parallel to each other and perpendicular to the first and second edges 92*a*, 92*b*.

The second panel segment 86 is planar and has first and second surfaces 94*a*, 94*b* which are defined by first and second edges 96*a*, 96*b*, a third edge 96*c* extending between the first and second edges 96*a*, 96*b* at the ends of the first and second edges 96*a*, 96*b*, and a fourth edge 96*d* extending between the first and second edges 96*a*, 96*b* at the opposite ends of the first and second edges 96*a*, 96*b*. The first and second edges 96*a*, 96*b* define a width of the second panel segment 86 therebetween; the third and fourth edges 96*c*, 96*d* define a length of the second panel segment 86 therebetween. In an embodiment, the first and second edges 96*a*, 96*b* are parallel to each other and the third and fourth edges 96*c*, 96*d* are parallel to each other and perpendicular to the first and second edges 96*a*, 96*b*.

The third panel segment 88 is planar and has first and second surfaces 98*a*, 98*b* which are defined by first and second edges 100*a*, 100*b*, a third edge 100*c* extending between the first and second edges 100*a*, 100*b* at the ends of the first and second edges 100*a*, 100*b*, and a fourth edge 100*d* extending between the first and second edges 100*a*, 100*b* at the opposite ends of the first and second edges 100*a*, 100*b*. The first and second edges 100*a*, 100*b* define a width of the third panel segment 88 therebetween; the third and fourth edges 100*c*, 100*d* define a length of the third panel segment 88 therebetween. In an embodiment, the first and second edges 100*a*, 100*b* are parallel to each other and the third and fourth edges 100*c*, 100*d* are parallel to each other and perpendicular to the first and second edges 100*a*, 100*b*.

The first edge 92*a* of the first panel segment 84 is connected to the second edge 54*b* of the first side panel 42 at a fold line 102. The second edge 92*b* of the first panel segment 84 is connected to the first edge 96*a* of the second panel segment 86 at a fold line 104. The second edge 96*b* of the second panel segment 86 is connected to the first edge 100*a* of the third panel segment 88 at a fold line 106. In the unassembled and flattened condition as shown in FIGS. 5 and 6, the third edges 92*c*, 96*c*, 100*c* are aligned with each other and in some embodiments form a straight line, and the fourth edges 92*d*, 96*d*, 100*d* are aligned with each other and in some embodiments form a straight line or a generally straight line. In some embodiments, the fourth edge 100*d* is angled relative to the fourth edges 92*d*, 96*d*. In the assembled condition as shown in FIG. 1, the segments 84, 86 are folded relative to each other to form a V-shape.

The bottom panel 50 of the pop-up bag 26 is formed of first and second planar panels 110, 112 which are foldably attached to each other.

The first panel 110 is planar and has first and second surfaces 116*a*, 116*b* which are defined by first and second edges 118*a*, 118*b*, a third edge 118*c* extending between the first and second edges 118*a*, 118*b* at the ends of the first and second edges 118*a*, 118*b*, and a fourth edge 118*d* extending between the first and second edges 118*a*, 118*b* at the opposite ends of the first and second edges 118*a*, 118*b*. The first and second edges 118*a*, 118*b* define a width of the first panel 110 therebetween; the third and fourth edges 118*c*, 118*d* define a length of the first panel 110 therebetween. In an embodiment, the first and second edges 118*a*, 118*b* are parallel to each other and the third and fourth edges 118*c*, 118*d* are parallel to each other and perpendicular to the first and second edges 118*a*, 118*b*.

The second panel 112 is planar and has first and second surfaces 120*a*, 120*b* which are defined by first and second edges 122*a*, 122*b*, a third edge 122*c* extending between the first and second edges 122*a*, 122*b* at the ends of the first and second edges 122*a*, 122*b*, and a fourth edge 122*d* extending between the first and second edges 122*a*, 122*b* at the opposite ends of the first and second edges 122*a*, 122*b*. The first and second edges 122*a*, 122*b* define a width of the second panel 112 therebetween; the third and fourth edges 122*c*, 122*d* define a length of the second panel 112 therebetween. In an embodiment, the first and second edges 122*a*, 122*b* are parallel to each other and the third and fourth edges 122*c*, 122*d* are parallel to each other and perpendicular to the first and second edges 122*a*, 122*b*.

The first and second panels 110, 112 are attached to each other along a fold line 124 which is provided at the third edge 118*c* of the first panel 110 and at the fourth edge 122*d* of the second panel 112, such that when the panels 110, 112 are folded onto each other into the folded condition, the first surfaces 116*a*, 120*a* face each other. In an embodiment, when the pop-up bag 26 is the unfolded condition, the first edges 118*a*, 122*a* are aligned with each other and in some embodiments, the first edges 118*a*, 122*a* form a straight line; when the pop-up bag 26 is in the unfolded condition, the second edges 118*b*, 122*b* are aligned with each other and in some embodiments, the second edges 118*b*, 122*b* form a straight line. In an embodiment, the fourth edges 118*d*, 122*d* are parallel to each other and in some embodiments, the fourth edges 118*d*, 122*d* form straight lines.

The first panel 110 is attached to the first side panel 42 at a fold line 126 which is provided at the fourth edge 118*d* of the first panel 110 and at the third edge 38*c* of the first side panel 42. The second panel 112 is attached to the second side panel 44 at a fold line 128 which is provided at the third edge 122*c* of the second panel 112 and at the fourth edge 58*d* of the second side panel 44.

FIGS. 5 and 6 show an embodiment of the pop-up bag 26 in the unassembled and flattened condition. As shown, the third edges 54*c*, 68*c*, 72*c*, 76*c*, 92*c*, 96*c*, 100*c* are aligned with each other and in some embodiments form a straight line, and the fourth edges 54*d*, 68*d*, 72*d*, 92*d*, 96*d* are aligned with each other and in some embodiments form a straight line or a generally straight line. The fourth edges 76*d*, 100*d* are angled relative to the respective fourth edges 68*d*, 72*d* and 92*d*, 96*d*. The third edges 54*c*, 68*c*, 72*c*, 76*c*, 92*c*, 96*c*, 100*c* are parallel to the fourth edges 54*d*, 68*d*, 72*d*, 76*d*, 92*d*, 96*d*, 100*d* and are parallel to the edges 118*c*, 118*d*, 122*c*, 122*d* of the bottom panel 50. The edges 54*a*, 118*a*, 122*a*, 58*a* are aligned with each other and in some embodiments form a straight line. The edges 54*b*, 118*b*, 122*b*, 58*b* are aligned with each other and in some embodiments form a straight line.

In some embodiments, the panels 42, 44, 60, 62, 84, 86, 110, 112 are formed as rectangles. Other shapes, for example, a square, may be used.

An example embodiment of the formation of the packet 20 is described herein. While the formation of the packet 20 is described in a particular order, it is to be understood that the order can be changed.

Figure 7:
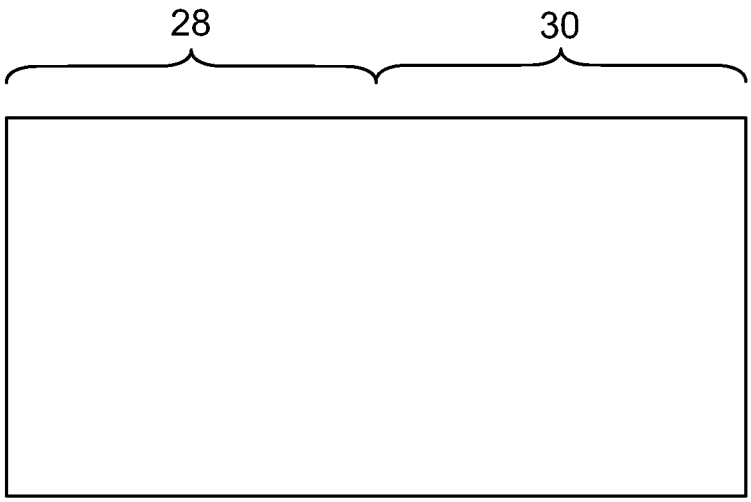
FIG. 7 is a top plan view of a blank used to form the carrier.

FIG. 7 shows the carrier 24 as it is formed as a blank.

Figure 8:
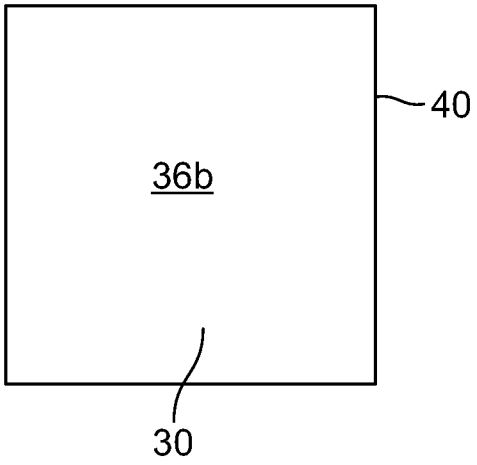
FIG. 8 is a top plan view of the blank of FIG. 7 after it has been formed into the carrier.

To form the carrier 24, the blank of FIG. 7 is folded along fold line 40 so that surfaces 32*a*, 36*a* face each other, see FIG. 8. Thereafter, the blank is unfolded along fold line 40 so that the pop-up bag 26 can be mated therewith after the pop-up bag 26 is formed.

Figure 9:
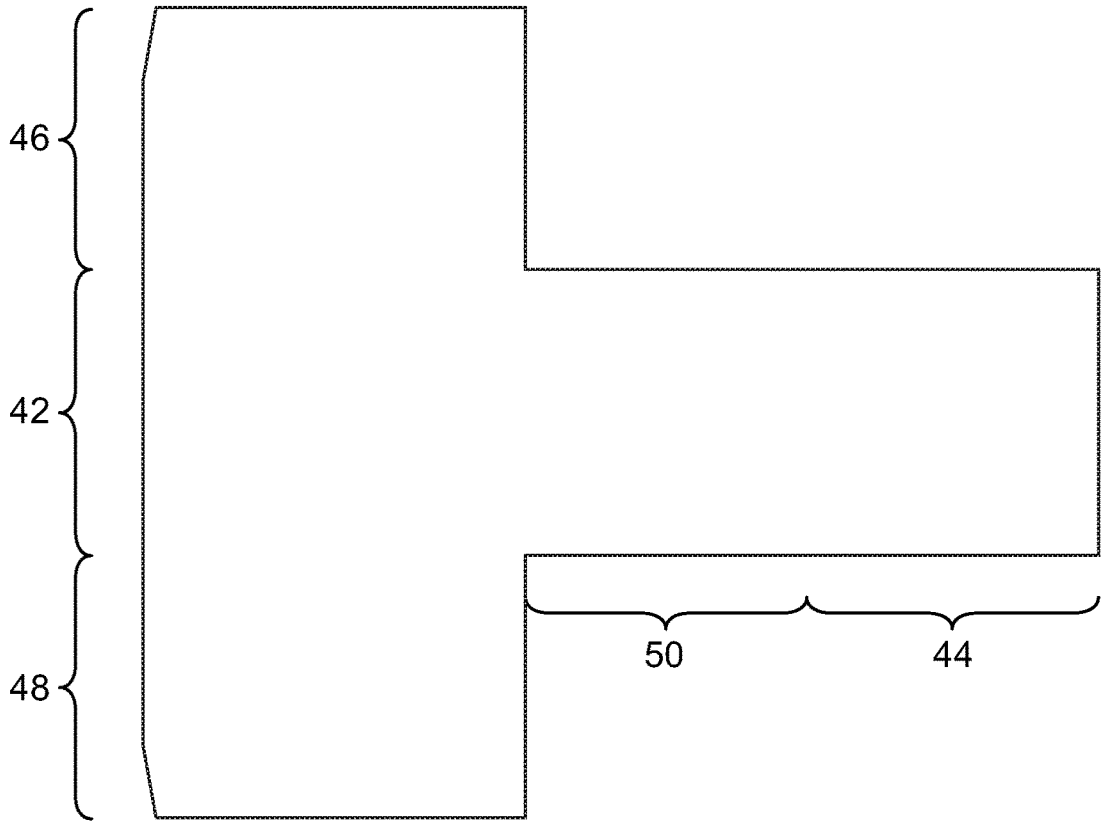
FIG. 9 is a top plan view of a blank used to form the pop-up bag.

FIG. 9 shows the pop-up bag 26 as it is formed as a blank.

To form the third side panel 46, the blank of FIG. 9 is folded on fold line 78, see FIG. 5, so that surfaces 66*a*, 70*a*, 74*a* face surface 52*a*. The blank of FIG. 9 is folded on fold line 80, see FIG. 5, so that surface 66*b* faces surface 70*b*. The blank of FIG. 9 is then folded on fold line 82, see FIG. 5, so that surface 74*a* faces surface 70*a*.

To form the third side panel 48, the blank of FIG. 9 is folded on fold line 102, see FIG. 5, so that surfaces 90*a*, 94*a*, 98*a* face surface 52*a*. The blank of FIG. 9 is then folded on fold line 104, see FIG. 5, so that surface 90*b* faces surface 94*b*. The blank of FIG. 9 is then folded on fold line 108, see FIG. 5, so that surface 98*a* faces surface 94*a*.

To form the bottom panel 50, the blank of FIG. 9 is folded on fold line 126, see FIG. 5, so that surfaces 116*a*, 120*a* and part of surface 56*a* face surface 52*a*. The blank of FIG. 9 is then unfolded along fold line 126. The blank of FIG. 9 is then folded on fold line 124, see FIG. 5, so that surfaces 120*a*, 56*a* face surfaces 116*a*, 52*a*. The blank of FIG. 9 is then unfolded along fold line 124. The blank of FIG. 9 is then folded on fold line 128, see FIG. 5, so that surface 56*a* faces surfaces 120*a*, 116*a*, 52*a*. The blank of FIG. 9 is then unfolded along fold line 128.

Figure 10:
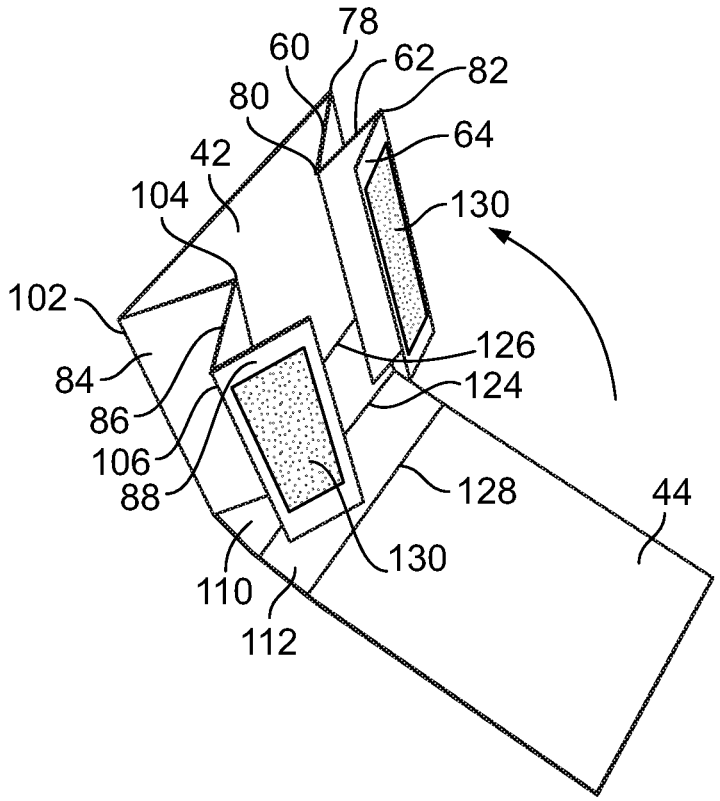
FIG. 10 is a perspective view of the pop-up bag during assembly.

Adhesive 130, see FIG. 10, is applied to the surfaces 74*b*, 98*b* and/or to surface 56*a* where the second side panel 44 will engage with flap panel segment 64 and with flap panel segment 88, and the blank is folded along fold line 124 such that surface 56*a* comes into contact with the adhesive 130 and is adhered thereto.

This completes the formation of the pop-up bag 26.

Figure 11:
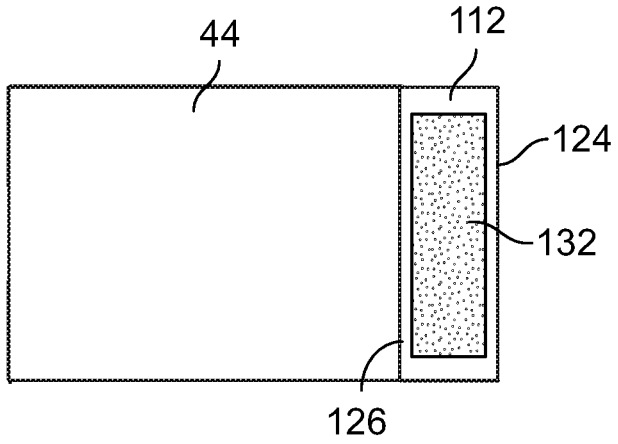
FIG. 11 is a plan view of the pop-up bag prior to being mounted to the carrier.

Adhesive 132, see FIG. 11, is applied to the surfaces 32*a*, 36*a* of the carrier 24 where the pop-up bag 26 is to be attached and/or to the surfaces 116*b*, 120*b* of the pop-up bag 26. Thereafter, the carrier 24 and the pop-up bag 26 are mated together by aligning the fold line 124 of the pop-up bag 26 with the fold line 40 of the carrier 24 and adhering the pop-up bag 26 and the carrier 24 together by the adhesive 132.

When the packet 20 is in the folded condition as shown in FIG. 2, surface 32*a* faces surface 36*a* with the pop-up bag 26 therebetween such that surface 32*a* also faces surface 52*b* and surface 36*a* also faces surface 56*b*. In the folded condition as shown in FIG. 2, the third side panel 46 is folded such that surface 66*b* faces surface 70*b*, and the fourth side panel 48 is folded such that surface 90*b* faces surface 94*b*. In the folded condition as shown in FIG. 2, surface 52*a* faces surfaces 66*a*, 90*a*, 56*a*, and surface 56*a* faces surfaces 70*a*, 94*a*, 52*a*. When folded as shown in FIG. 2, the pop-up bag 26 is substantially hidden within the carrier 24.

To unfold the packet 20 to expose the pop-up bag 26 as shown in FIG. 1, one of the panels of the carrier 24 is pulled away from the other panel. As an example, panel 30 is pulled away from panel 28 by unfolding fold line 40. Since the panel 110 of the pop-up bag 26 is affixed to the panel 28 of the carrier 24 and since panel 112 of the pop-up bag 26 is affixed to the panel 30 of the carrier 24, panel 110 and panel 28 move with each other and panel 112 and panel 30 move with each other. This causes the panels 110, 112 to unfold along fold line 124 which separates panel 42 from panel 44 and cause panels 42 and 44 to move away from each other. As the panels 42, 44 move away from each other, the side panels 46 and 48 unfold along fold lines 80 and 104 to expand. The goods 22 within the pop-up bag 26 are then made visible to the consumer and the consumer can reach into the expanded pop-up bag 26 and take the goods 22 out of the pop-up bag 26 (or goods can be put into the pop-up bag 26).

To fold the packet 20 to the condition shown in FIG. 2, to hide the pop-up bag 26, one of the panels of the carrier 24 is moved toward the other panel. As an example, panel 30 is moved toward panel 28 by folding fold line 40. Since the panel 110 of the pop-up bag 26 is affixed to the panel 28 of the carrier 24 and since panel 112 of the pop-up bag 26 is affixed to the panel 30 of the carrier 24, panel 110 and panel 28 move with each other and panel 112 and panel 30 move with each other. This causes the panels 110, 112 to fold along fold line 124 which causes panel 42 to move toward panel 44. As the panels 42, 44 move toward each other, the side panels 46 and 48 fold along fold lines 80 and 104 to contract.

In an embodiment, the panels 28, 30 of the carrier 24 are larger than the panels 42, 44 of the pop-up bag 26 such that pop-up bag 26 is hidden from view by the carrier 24 so that when a consumer unfolds the package 20, the pop-up bag 26 presents a "surprise" to the consumer. In some embodiments, the panels 28, 30 of the carrier 24 may be smaller than the panels 42, 44 of the pop-up bag 26 such that pop-up bag 26 is not hidden from view by the carrier 24.

In an embodiment, the pop-up bag 26 is centered along the width of the carrier 24. In some embodiments, the pop-up bag 26 is not centered along the width of the carrier 24.

The packet 20 can have indicia, such words, illustrations, photographs, artwork, etc., on any of the surfaces of any of the panels.

While a single sheet is described to form each of the carrier 24 and the pop-up bag 26, multiple sheets could be provided and bonded together.

While adhesive is shown and described, it is to be understood that the adhesive could be replaced by other means for joining the panels together, such as staples.

While a particular embodiment is illustrated in and described with respect to the drawings, it is envisioned that those skilled in the art may devise various modifications without departing from the spirit and scope of the appended claims. It will therefore be appreciated that the scope of the disclosure and the appended claims is not limited to the specific embodiments illustrated in and discussed with respect to the drawings and that modifications and other embodiments are intended to be included within the scope of the disclosure and appended drawings. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the disclosure and the appended claims.

What is claimed is:

1. A packet configured to hold goods therein comprising:

a carrier formed of paper or cardboard and comprised of a first panel and a second panel, the first and second panels being separated by a fold line;

a pop-up bag formed of paper or cardboard mounted on the carrier, the pop-up bag comprised of a first side panel, a second side panel, a third side panel, a fourth side panel and a bottom panel, the first, second, third and fourth side panels being connected together, the third side panel connecting the first and second side panels together at a first edge of each of the first and second side panels, the third side panel having at least one fold line therein between the first and second panels, the fourth side panel connecting the first and second side panels together at a second edge of each of the first and second side panels, the fourth side panel having at least one fold line therein between the first and second panels, the bottom panel formed of a first panel and a second panel which are separated by a fold line, the first panel of the bottom panel directly connected to the first side panel and the second panel of the bottom panel directly connected to the second side panel;

wherein the first panel of the bottom panel of the pop-up bag is affixed to the first panel of the carrier and moves with the first panel of the carrier when the carrier is unfolded, the second panel of the bottom panel of the pop-up bag is affixed to the second panel of the carrier and moves with the first panel of the carrier when the carrier is unfolded, and the fold line of the pop-up bag is aligned with the fold line of the carrier, such that the carrier and the pop-up bag can be moved to a folded condition or to an unfolded condition.

2. The packet of claim 1, wherein the third side panel of the pop-up bag is formed of a first panel segment and a second panel segment which are foldably connected to each other by a fold line, the first panel segment being attached to the first side panel by a fold line, and the fourth side panel of the pop-up bag is formed of a first panel segment and a second panel segment which are foldably connected to each other by a fold line, the first panel segment of the fourth side panel being attached to the first side panel by a fold line.

3. The packet of claim 1, wherein each of the third and fourth side panels form a V-shape.

4. The packet of claim 1, wherein the first panel of the bottom panel of the pop-up bag is affixed to the first panel of the carrier by adhesive, and the second panel of the bottom panel of the pop-up bag is affixed to the second panel of the carrier by adhesive.

5. The packet of claim 1, wherein the first and second panels of the carrier are larger than the first and second side panels of the pop-up bag.

6. The packet of claim 1, wherein the pop-up bag is centered on the carrier.

7. The packet of claim 1, wherein the panels of the carrier are rectangular and the first and second side panels of the pop-up bag are rectangular.

8. The packet of claim 1, wherein the bottom panel is integrally formed with the first and second side panels.

9. The packet of claim 1, wherein the carrier is formed of a single sheet of material.

10. The packet of claim 1, wherein the pop-up bag is formed of a single sheet of material.

11. The packet of claim 1, wherein the carrier is formed of a single sheet of material, and the pop-up bag is formed of a single sheet of material.

12. The packet of claim 1 in combination with goods placed within the pop-up bag.

13. The packet of claim 1, wherein when the carrier and the pop-up bag are in the folded condition, the at least one fold line of the third side panel is positioned between the first and second side panels, and the at least one fold line of the fourth side panel is positioned between the first and second side panels.

14. The packet of claim 1, wherein when the carrier and the pop-up bag are in the folded condition, the at least one fold line of the third side panel is positioned between the first and second side panels.

15. A packet configured to hold goods therein comprising:

a carrier formed of paper or cardboard and comprised of a first panel and a second panel, the first and second panels being separated by a fold line;

a pop-up bag formed of paper or cardboard mounted on the carrier, the pop-up bag comprised of a first side panel, a second side panel, a third side panel, a fourth side panel and a bottom panel, the first, second, third and fourth side panels being connected together, the third side panel connecting the first and second side panels together at a first edge of each of the first and second side panels, the third side panel is formed of a first panel segment and a second panel segment which are foldably connected to each other by a fold line, the first panel segment being attached to the first side panel by a fold line, the third side panel further including a flap panel segment foldably attached to the second panel segment of the third side panel by a fold line, the flap panel segment being affixed to the second side panel, the fourth side panel connecting the first and second side panels together at a second edge of each of the first and second side panels, the fourth side panel is formed of a first panel segment and a second panel segment which are foldably connected to each other by a fold line, the first panel segment of the fourth side panel being attached to the first side panel by a fold line, the fourth side panel further including a flap panel segment foldably attached to the second panel segment of the fourth side panel by a fold line, the flap panel segment of the fourth side panel being affixed to the second side panel, the bottom panel formed of a first panel and a second panel which are separated by a fold line, the first panel of the bottom panel directly connected to the first side panel and the second panel of the bottom panel directly connected to the second side panel;

wherein the first panel of the bottom panel of the pop-up bag is affixed to the first panel of the carrier and moves with the first panel of the carrier when the carrier is unfolded, the second panel of the bottom panel of the pop-up bag is affixed to the second panel of the carrier and moves with the first panel of the carrier when the carrier is unfolded, and the fold line of the pop-up bag is aligned with the fold line of the carrier, such that the carrier and the pop-up bag can be moved to a folded condition or to an unfolded condition.

16. The packet of claim 15, wherein the flap panel segment of the third side panel is affixed to the second side panel by adhesive, and the flap panel segment of the fourth side panel is affixed to the second side panel by adhesive.

17. A packet configured to hold goods therein comprising:

a carrier formed of a single sheet of paper or cardboard and comprised of a first panel and a second panel, the first and second panels being separated by a fold line;

a pop-up bag formed of a single sheet of paper or cardboard and mounted on the carrier, the pop-up bag comprised of a first side panel, a second side panel, a third side panel, a fourth side panel and a bottom panel, the first, second, third and fourth side panels being connected together, the third side panel connecting the first and second side panels together at a first edge of each of the first and second side panels, the third side panel being formed of a first panel segment and a second panel segment which are foldably connected to each other by a fold line, the first panel segment being attached to the first side panel by a fold line, the third side panel further being formed of a flap panel segment foldably attached to the second panel segment by a fold line and being foldably attached to the second side panel by a fold line, the flap panel segment further being affixed to the second side panel by adhesive, the fourth side panel connecting the first and second side panels together at a second edge of each of the first and second side panels, the fourth side panel being formed of a first panel segment and a second panel segment which are foldably connected to each other by a fold line, the first panel segment of the fourth side panel being attached to the first side panel by a fold line, the fourth side panel further being formed of a flap panel segment foldably attached to the second panel segment of the fourth side panel by a fold line and being foldably attached to the second side panel by a fold line, the flap panel segment of the fourth side panel further being affixed to the second side panel by adhesive, the bottom panel formed of a first panel and a second panel which are separated by a fold line, the first panel of the bottom panel directly connected to the first side panel and the second panel of the bottom panel directly connected to the second side panel;

the first panel of the bottom panel of the pop-up bag is affixed to the first panel of the carrier by adhesive, and the second panel of the bottom panel of the pop-up bag is affixed to the second panel of the carrier by adhesive; and wherein the first panel of the bottom panel of the pop-up bag is affixed to the first panel of the carrier and moves with the first panel of the carrier when the carrier is unfolded, the second panel of the bottom panel of the pop-up bag is affixed to the second panel of the carrier and moves with the first panel of the carrier when the carrier is unfolded, and the fold line of the pop-up bag is aligned with the fold line of the carrier, such that the carrier and the pop-up bag can be moved to a folded condition or to an unfolded condition.

18. The packet of claim 17, wherein each of the third and fourth side panels form a V-shape.

19. The packet of claim 17, wherein the first and second panels of the carrier are larger than the first and second side panels of the pop-up bag.

20. The packet of claim 17, wherein the pop-up bag is centered on the carrier.

21. The packet of claim 17, wherein the panels of the carrier are rectangular and the first and second side panels of the pop-up bag are rectangular.

22. The packet of claim 17 in combination with goods placed within the pop-up bag.

* * * * *